US009817334B2

(12) United States Patent
Kobayashi

(10) Patent No.: US 9,817,334 B2
(45) Date of Patent: Nov. 14, 2017

(54) IMAGE FORMATION UNIT AND IMAGE FORMATION APPARATUS

(71) Applicant: Oki Data Corporation, Tokyo (JP)

(72) Inventor: Atsushi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/244,381

(22) Filed: Aug. 23, 2016

(65) Prior Publication Data

US 2017/0060022 A1 Mar. 2, 2017

(30) Foreign Application Priority Data

Aug. 31, 2015 (JP) ..... 2015-170608

(51) Int. Cl.
*G03G 15/08* (2006.01)

(52) U.S. Cl.
CPC ..... *G03G 15/0812* (2013.01)

(58) Field of Classification Search
CPC ..... G03G 15/081; G03G 15/0812
USPC ..... 399/284
See application file for complete search history.

(56) References Cited

U.S. PATENT DOCUMENTS 5,937,253 A * 8/1999 Shimazaki ..... G03G 15/0812 118/261
2003/0235438 A1* 12/2003 Tatsumi ..... G03G 15/0812 399/284

FOREIGN PATENT DOCUMENTS

JP 2003-323017 A 11/2003

* cited by examiner

*Primary Examiner* — Billy Lactaoen
(74) *Attorney, Agent, or Firm* — Metrolexis Law Group, PLLC

(57) ABSTRACT

An image formation unit includes: an image carrier that carries an electrostatic latent image; a developer carrier that carries a developer and develops the electrostatic latent image on the image carrier; and a developer regulation member that includes a contact portion which comes into contact with a surface of the developer carrier and that regulates a thickness of a developer layer to be formed on the surface of the developer carrier. A value of D/L is greater than or equal to 0.283%, where D is an amount of displacement of the contact portion of the developer regulation member caused by the contact of the contact portion with the surface of the developer carrier, and L is a dimension of the developer regulation member in a longitudinal direction thereof.

13 Claims, 11 Drawing Sheets

Fig. 11
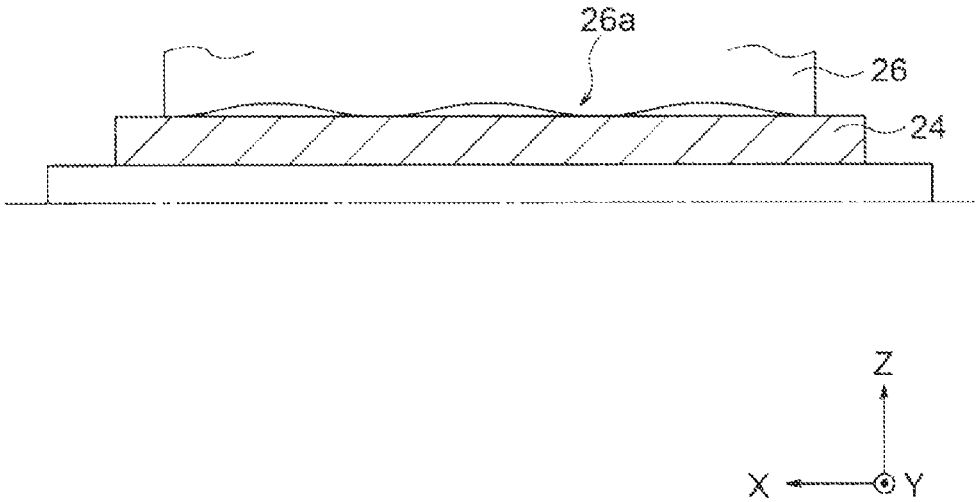
Fig. 12
| VALUE OF D/L (%) | BEND ANGLE α (°) | WIDTH W1 OF TIP FLAT PORTION (mm) | THICKNESS t (mm) | OCCURRENCE OF PRINT DEFECT | DETERMINATION RESULT |
|---|---|---|---|---|---|
| 0.148 | 90 | 1.4 | 0.08 | OCCURRED | BAD |
| 0.274 | 90 | 0.5 | 0.08 | SLIGHTLY OCCURRED | NOT GOOD |
| 0.283 | 115 | 0.5 | 0.08 | NOT OCCURRED | GOOD |
| 0.295 | 135 | 0.5 | 0.08 | NOT OCCURRED | GOOD |
| 0.376 | 135 | 0.5 | 0.06 | NOT OCCURRED | GOOD |
Fig. 13
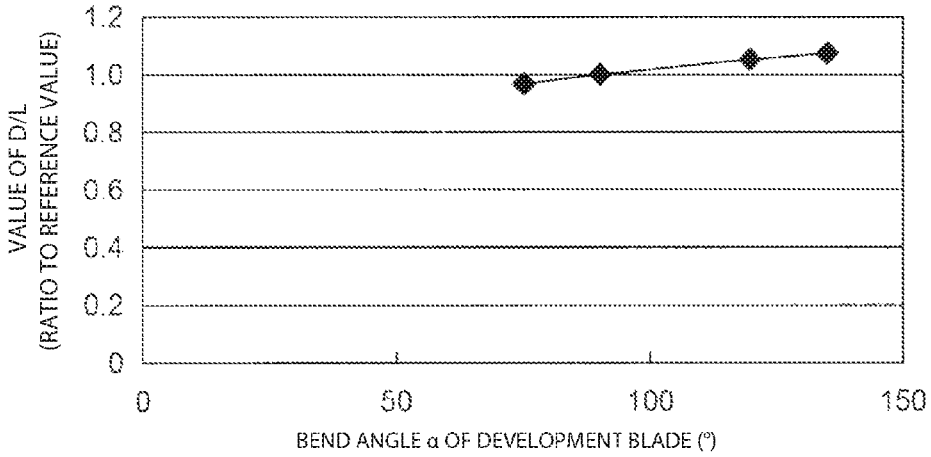

IMAGE FORMATION UNIT AND IMAGE FORMATION APPARATUS

CROSS REFERENCE TO RELATED APPLICATIONS

This application claims priority based on 35 USC 119 from prior Japanese Patent Application No. 2015-170608 filed on Aug. 31, 2015, entitled "IMAGE FORMATION UNIT AND IMAGE FORMATION APPARATUS", the entire contents of which are incorporated herein by reference.

BACKGROUND OF THE INVENTION

1. Field of the Invention

This disclosure relates to image formation apparatuses such as printers, photocopiers, facsimiles, and multi-function peripherals (MFPs) that use xerography and to image formation units.

2. Description of Related Art

Image formation apparatuses that use xerography form a developer layer of a certain thickness on the surface of a development roller by adhering a developer to the surface of the development roller and pressing a development blade (developer regulation member) against the surface of the development roller (see Japanese Patent Application Publication No. 2003-323017 (paragraphs 0004 to 0006), for example).

SUMMARY OF THE INVENTION

The length of the development blade needs to be as large as, or larger than, the width of paper sheets, and is generally 200 mm to 350 mm. Also, the development blade is subjected to bending at its contact portion with the development roller, and the bending is likely to generate small waviness on the surface of the contact portion. The generation of the waviness causes an uneven contact with the development roller. This results in a problem in that the thickness of the developer layer becomes uneven, and print defects such as a density unevenness and vertical strips occur.

An embodiment of the invention aims to suppress the occurrence of print defects resulting from a waviness of a developer regulation member.

A first aspect of the invention is an image formation unit that includes: an image carrier that carries an electrostatic latent image; a developer carrier that carries a developer and develops the electrostatic latent image on the image carrier; and a developer regulation member that includes a contact portion which comes into contact with a surface of the developer carrier and that regulates a thickness of a developer layer to be formed on the surface of the developer carrier. A value of D/L is greater than or equal to 0.283%, where D is the amount of displacement of the contact portion of the developer regulation member caused by the contact of the contact portion with the surface of the developer carrier, and L is the dimension of the developer regulation member in the longitudinal direction thereof.

The above aspect of the invention can suppress print defects by suppressing the waviness of the developer regulation member and thus forming a developer layer of an even thickness.

BRIEF DESCRIPTION OF THE DRAWINGS

FIG. 11 is a schematic view for explaining how the development blade having waviness on its contact portion comes into contact with the development roller.

FIG. 12 is a graph illustrating the result of a print test conducted with the value of D/L varied in the embodiment of the invention.

FIG. 13 is a graph illustrating changes in the value of D/L versus the bend angle of the development blade.

DETAILED DESCRIPTION OF EMBODIMENTS

Figure 1:
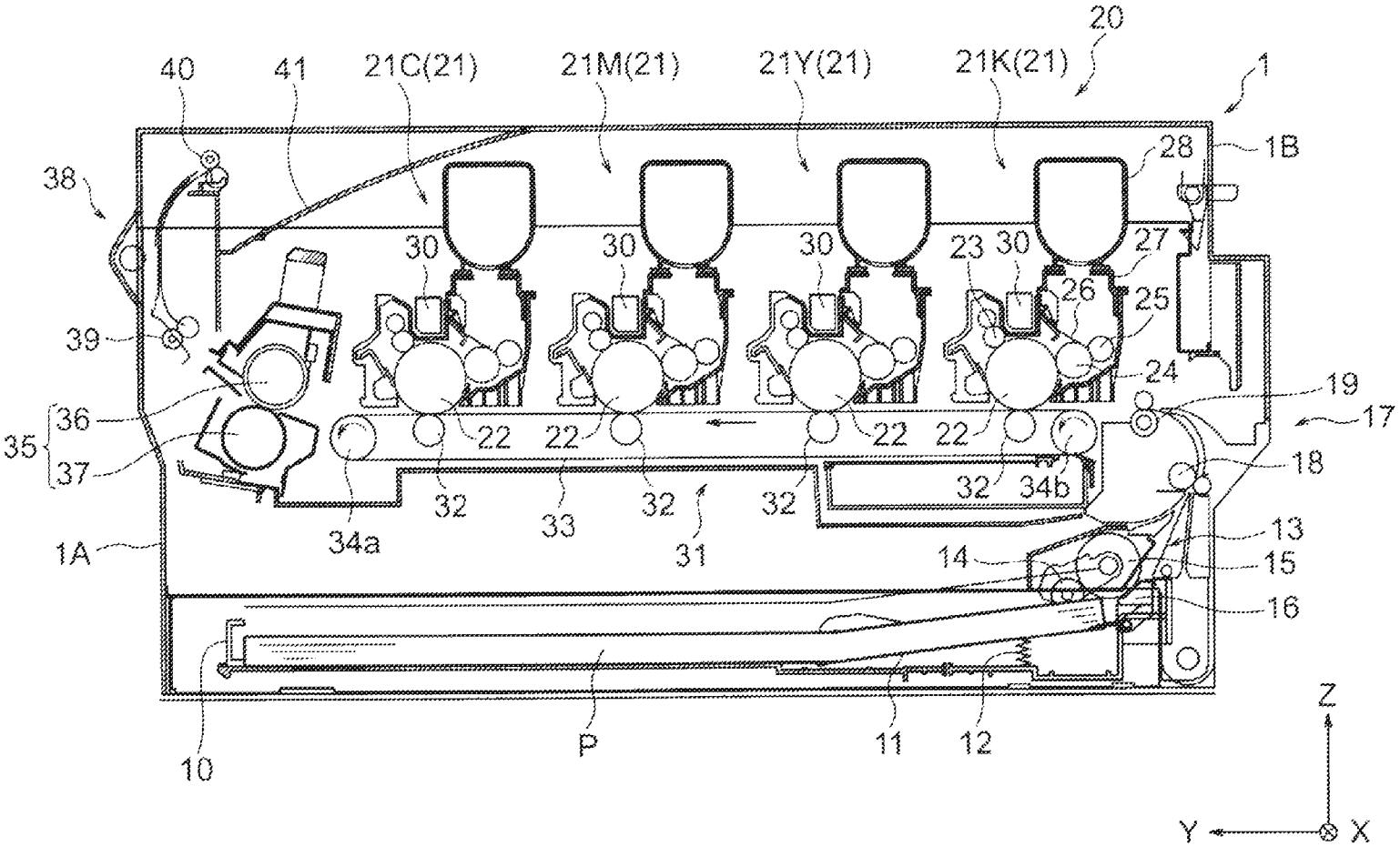
FIG. 1 is a view illustrating the overall configuration of an image formation apparatus in an embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

<Configuration of Image Formation Apparatus>

Figure 2:
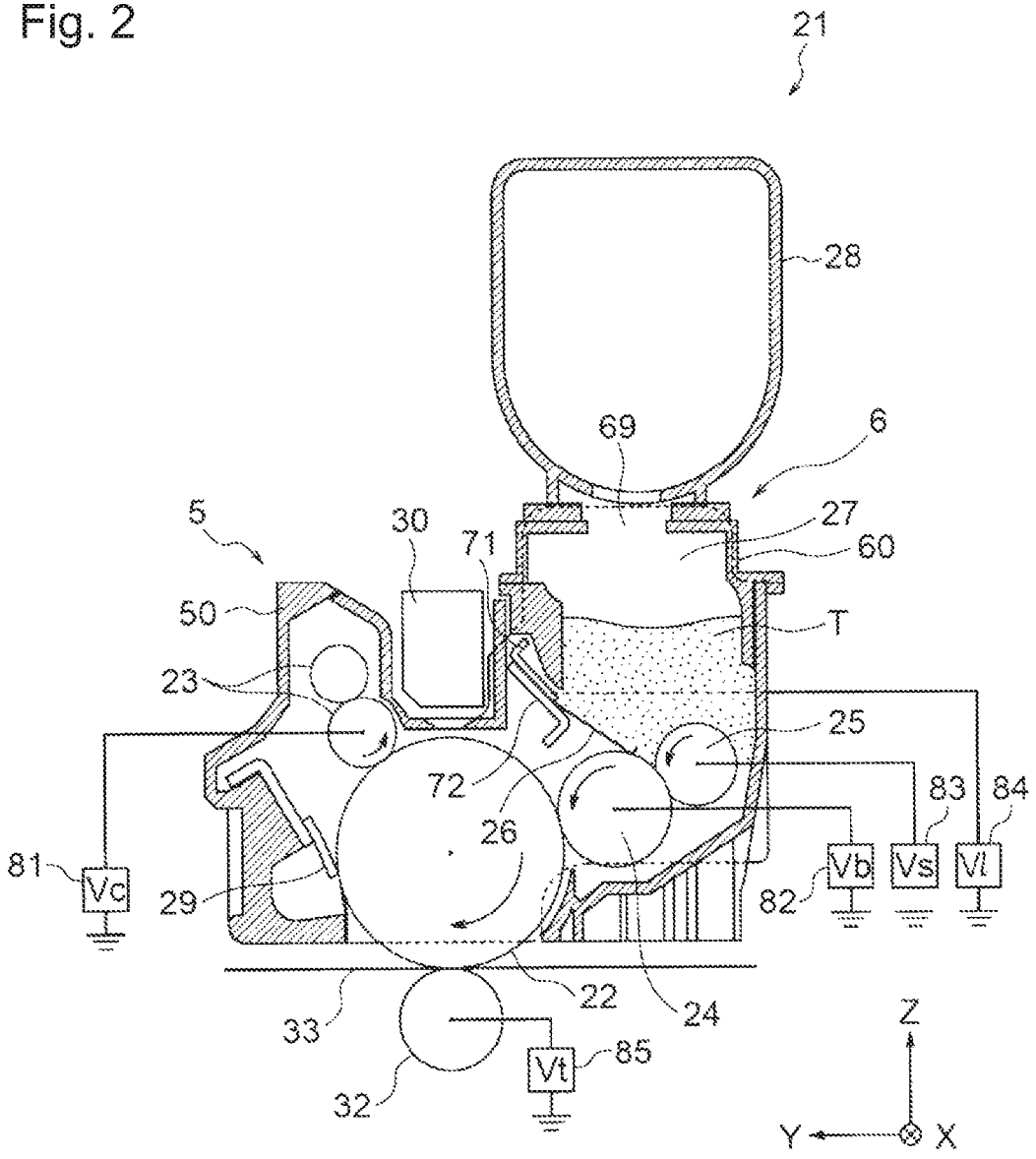
FIG. 2 is a view illustrating the configuration of an image formation unit in the embodiment of the invention.

First, the overall configuration of an image formation apparatus in an embodiment of the invention is described. FIG. 1 is a view illustrating the overall configuration of image formation apparatus 1 in the embodiment. FIG. 2 is a view illustrating the configuration of process unit 21 in image formation apparatus 1 in FIG. 1.

Image formation apparatus 1, illustrated in FIG. 1, forms images by using xerography and is constructed here as a color printer. Image formation apparatus 1 includes paper feed cassette 10 (serving as a medium storage), paper feeder 13, conveyor 17, image formation section 20, transfer belt unit 31 (serving as a transfer unit), fixation device 35 (serving as a fixation unit), and discharge unit 38.

Paper feed cassette 10 is a storage which stores paper sheets P as media. Paper feed cassette 10 includes sheet plate 11 on which to place paper sheets P, and spring 12 which upwardly biases sheet plate 11.

Paper feeder 13 separately and individually feeds paper sheets P stored in paper feed cassette 10 onto a conveyance path. Paper feeder 13 includes pick-up roller 14 that picks up paper sheets P stored in paper feed cassette 10, and feed roller 15 and separation piece 16 that individually feed picked paper sheets P onto the conveyance path.

Pick-up roller 14 is disposed in contact with top paper sheet P stored in paper feed cassette 10, and rotates in the counterclockwise direction in the figure to pull out paper sheet P. Feed roller 15 is disposed adjacently to pick-up roller 14, and feeds paper sheet P pulled out by pick-up roller 14 onto the conveyance path. Separation piece 16 is disposed to face feed roller 15, and prevents any multi-feed of paper sheets P by coming into frictional contact with paper sheets P.

The conveyor 17 conveys paper sheet P, fed onto the conveyance path by paper feeder 13, toward image formation section 20. Conveyor 17 includes first registration roller pair 18 and second registration roller pair 19 along the conveyance path.

First registration roller pair 18 starts to rotate at a predetermined timing after a paper feed sensor (not illustrated) detects the passage of the leading end of paper sheet P. Specifically, first registration roller pair 18 starts to rotate after the leading end of paper sheet P hits a nip portion between both rollers, thereby conveying paper sheet P with its skew corrected. Second registration roller pair 19 conveys paper sheet P conveyed from first registration roller pair 18 further toward image formation section 20. Note that paper feed cassette 10, paper feeder 13, and conveyor 17 form a medium feeder.

Image formation section 20 includes process units (image formation units) 21K, 21Y, 21M, 21C along the direction of the conveyance of paper sheet P. Process units 21K, 21Y, 21M, 21C are units that form black, yellow, magenta, and cyan images, respectively, and are detachably provided to housing 1A of image formation apparatus 1.

Process units 21K, 21Y, 21M, 21C have the same configuration except for the developers (toners) they use, and are therefore described below collectively as "process unit 21."

As illustrated in FIG. 2, process unit 21 includes photosensitive drum 22 as an image carrier. Photosensitive drum 22 is obtained by forming a photosensitive layer including a charge generation layer and a charge transport layer onto the surface of a conductive cylindrical support, and rotates in the clockwise direction in the figure.

Charge rollers 23 as charge members, LED head 30 as an exposure device, development roller 24 as a developer carrier, and cleaning member 29 are disposed around photosensitive drum 22 along the direction of rotation of photosensitive drum 22.

Charge rollers 23 are rollers each obtained by providing a semiconductive elastic layer on the surface of a metallic shaft. Charge rollers 23 are disposed in contact with the surface of photosensitive drum 22, and rotate in such a way as to follow photosensitive drum 22. Charge voltage Vc is applied to charge rollers 23 from charge-roller power supply 81. With this, charge rollers 23 uniformly charge the surface of photosensitive drum 22. Note that, charge rollers 23 here include two rollers, but may be a single roller.

LED head 30 includes an LED (light emitting element) array, and forms an electrostatic latent image on the surface of photosensitive drum 22 by irradiating the surface of photosensitive drum 22 with light. Note that LED head 30 is attached to top cover 1B of image formation apparatus 1.

Development roller 24 is a roller obtained by providing a semiconductive elastic layer (e.g. semiconductive urethane rubber) on the surface of a metallic shaft. Development roller 24 is disposed in contact with the surface of photosensitive drum 22, and rotates in the direction opposite to the direction of rotation of photosensitive drum 22 (i.e. rotates in such a direction that the surfaces of their contact portions move in the same direction). Development voltage Vb is applied to development roller 24 from development-roller power supply 82. Development roller 24 carries a developer on its surface, and develops the electrostatic latent image formed on the surface of photosensitive drum 22 by adhering the developer to the electrostatic latent image.

Feed roller 25 as a developer feed member and development blade 26 as a developer regulation member are disposed around development roller 24. In a space above development roller 24, feed roller 25, and development blade 26 is developer storage chamber 27.

Feed roller 25 is a roller obtained by providing a foamed elastic layer on the surface of a metallic shaft. Feed roller 25 is disposed either in contact with the surface of development roller 24 or with a gap therebetween. Feed voltage Vs is applied to feed roller 25 from feed-roller power supply 83. Feed roller 25 feeds the developer stored in developer storage chamber 27 onto development roller 24.

Development blade 26 is a blade obtained by bending a metallic plate-shaped member, and its bent portion (contact portion 26*a*) is brought into contact with the surface of development roller 24. Blade voltage V1 is applied to development blade 26 from blade power supply 84. Development blade 26 regulates the thickness of the developer layer (thin toner layer) to be formed on the surface of development roller 24.

Developer cartridge 28 stores the developer and is detachably attached to the top of developer storage chamber 27, under which development roller 24 and feed roller 25 are disposed. Developer cartridge 28 replenishes the developer.

Cleaning member 29 is a cleaning blade disposed in contact with the surface of photosensitive drum 22, for example. Cleaning member 29 removes the developer remaining on the surface of photosensitive drum 22 after a transfer of the developer image to be described later.

Referring back to FIG. 1, transfer belt unit 31 is disposed below image formation section 20 to face image formation section 20. Transfer belt unit 31 includes transfer rollers 32 (transfer members) disposed to face photosensitive drums 22 of process units 21K, 21Y, 21M, 21C. Transfer belt unit 31 further includes transfer belt 33 provided to pass between photosensitive drums 22 and transfer rollers 32, and belt drive roller 34*a* and tension roller 34*b* on which this transfer belt 33 is laid in a tensioned state.

With a drive force from a belt motor (not illustrated), belt drive roller 34*a* rotates to run transfer belt 33 in the direction indicated by the arrows. Transfer belt 33 electrostatically attracts paper sheet P to its surface and conveys paper sheet P along the process units 21K, 21Y, 21M, 21C. Transfer voltage Vt (FIG. 2) is applied to transfer rollers 32 from transfer-roller power supply 85. With this transfer voltage Vt, transfer rollers 32 transfer the developer images formed on photosensitive drums 22 onto paper sheet P on transfer belt 33.

Fixation device 35 or a fusing device is disposed downstream of image formation section 20 and transfer belt unit 31 in the direction of the conveyance of paper sheet P. Fixation device 35 includes fixation roller 36 (or a fusing roller) and press roller 37. Fixation roller 36 incorporates a heater, and rotates by means of a fixation motor (not illustrated). Press roller 37 is pressed against the surface of fixation roller 36 to form a nip portion between itself and fixation roller 36. While holding paper sheet P in-between, fixation roller 36 and press roller 37 heat and press paper sheet P to fix the developer images onto paper sheet P.

Discharge unit 38 is disposed downstream of fixation device 35 in the direction of the conveyance of paper sheet P. Discharge unit 38 includes first discharge roller pair 39 and second discharge roller pair 40 which convey paper sheet P discharged from fixation device 35 along a discharge conveyance path and discharge paper sheet P to the outside of the apparatus. Also, top cover 1B of image formation apparatus 1 is provided with stacker unit 41 on which to place discharged paper sheet P.

Note that in FIG. 1, the axial direction of photosensitive drum 22 (i.e. the axial directions of charge rollers 23, development rollers 24, feed rollers 25, and transfer rollers 32) is an X direction. Moreover, the direction of movement of paper sheet P passing process units 21K, 21Y, 21M, 21C is a Y direction. An XY plane parallel to the X direction and the Y direction is a horizontal plane. The direction orthogonal to the XY plane is a Z direction (vertical direction).

<Configuration of Image Formation Unit>

As illustrated in FIG. 2, each process unit 21 includes drum unit 5 (first unit) and development unit 6 (second unit). Drum unit 5 is apart that includes the above-described photosensitive drum 22 and charge rollers 23. Development unit 6 is a part that includes the above-described development roller 24, feed roller 25, development blade 26, and developer storage chamber 27. Developer cartridge 28 is detachably attached to the top of development unit 6.

Figure 3:
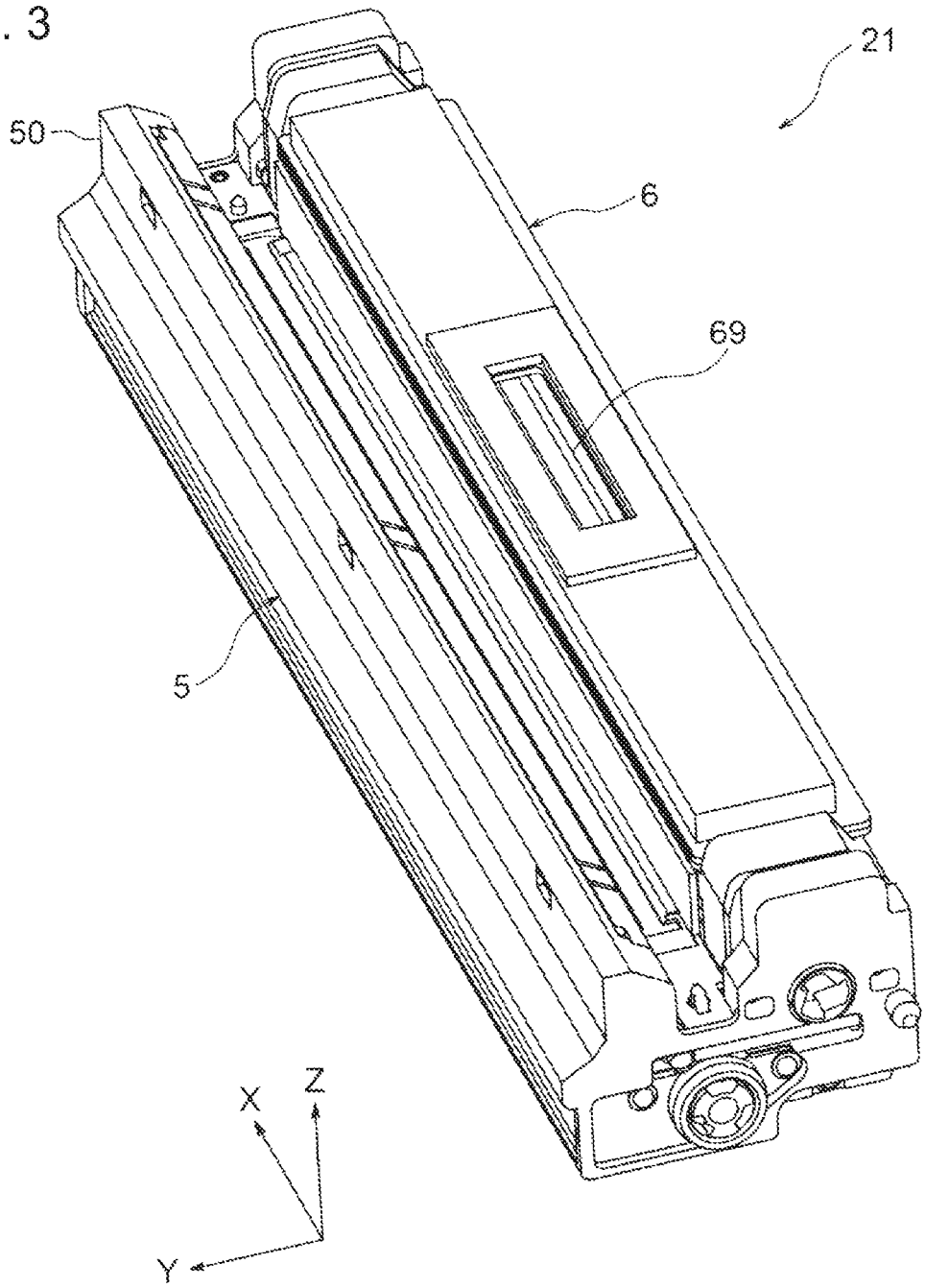
FIG. 3 is a perspective view illustrating the external shape of the image formation unit in the embodiment of the invention.
Figure 4:
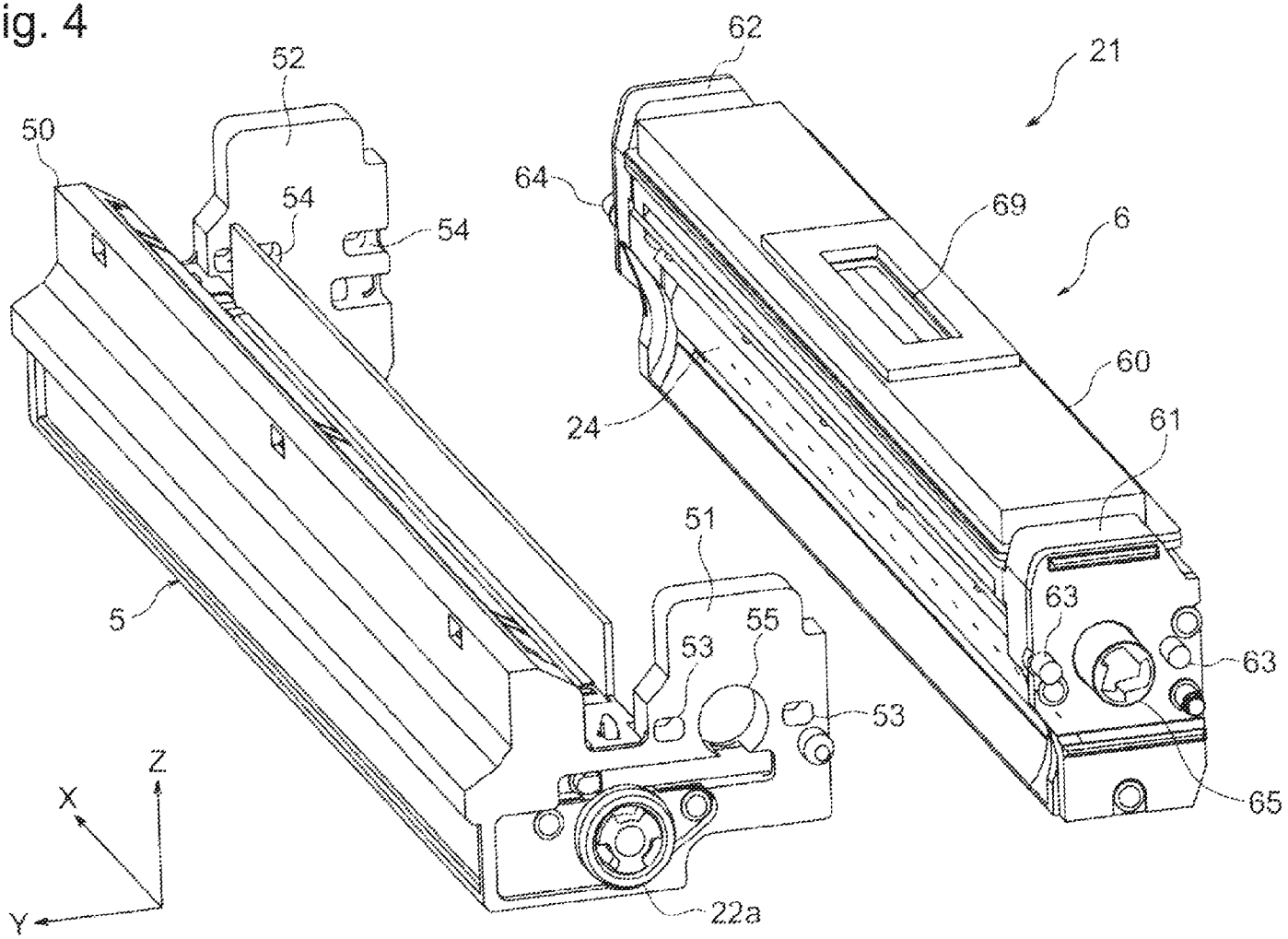
FIG. 4 is an exploded perspective view illustrating a drum unit and a development unit which form the image formation unit in the embodiment of the invention.
Figure 5:
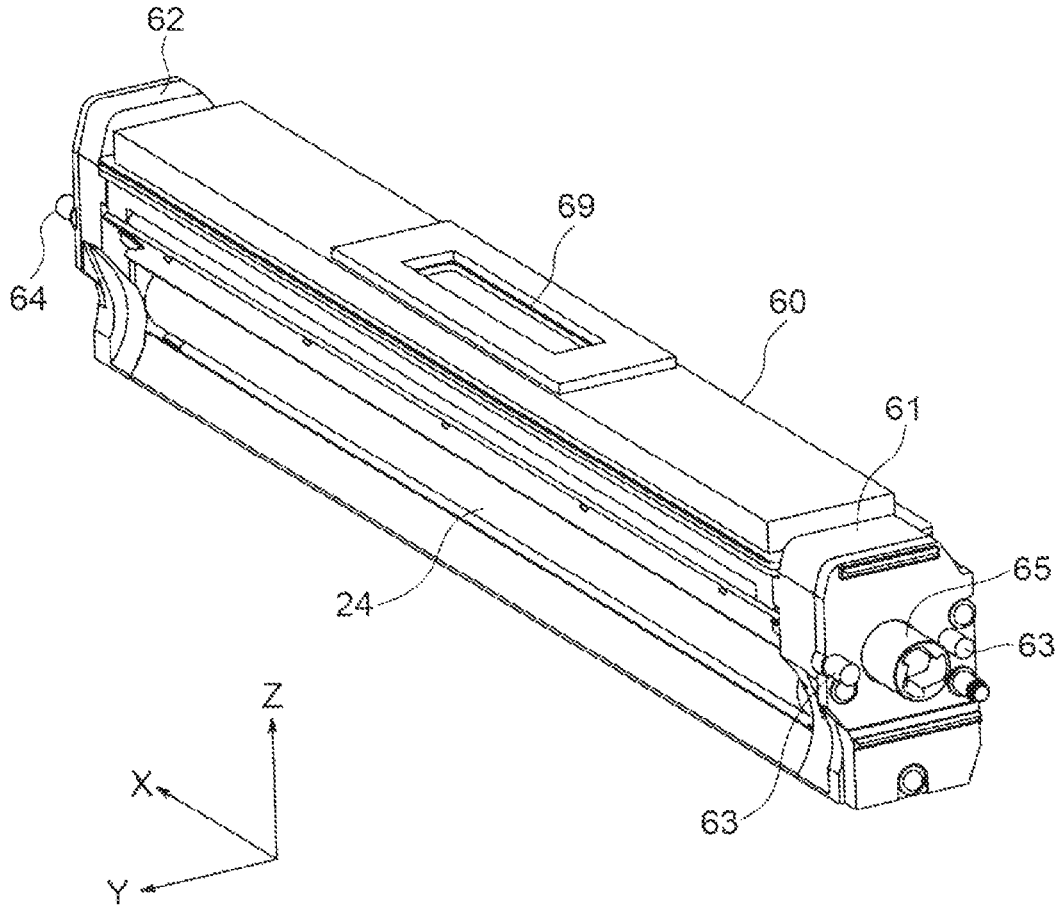
FIG. 5 is a perspective view illustrating the external shape of the development unit in the embodiment of the invention.
Figure 6:
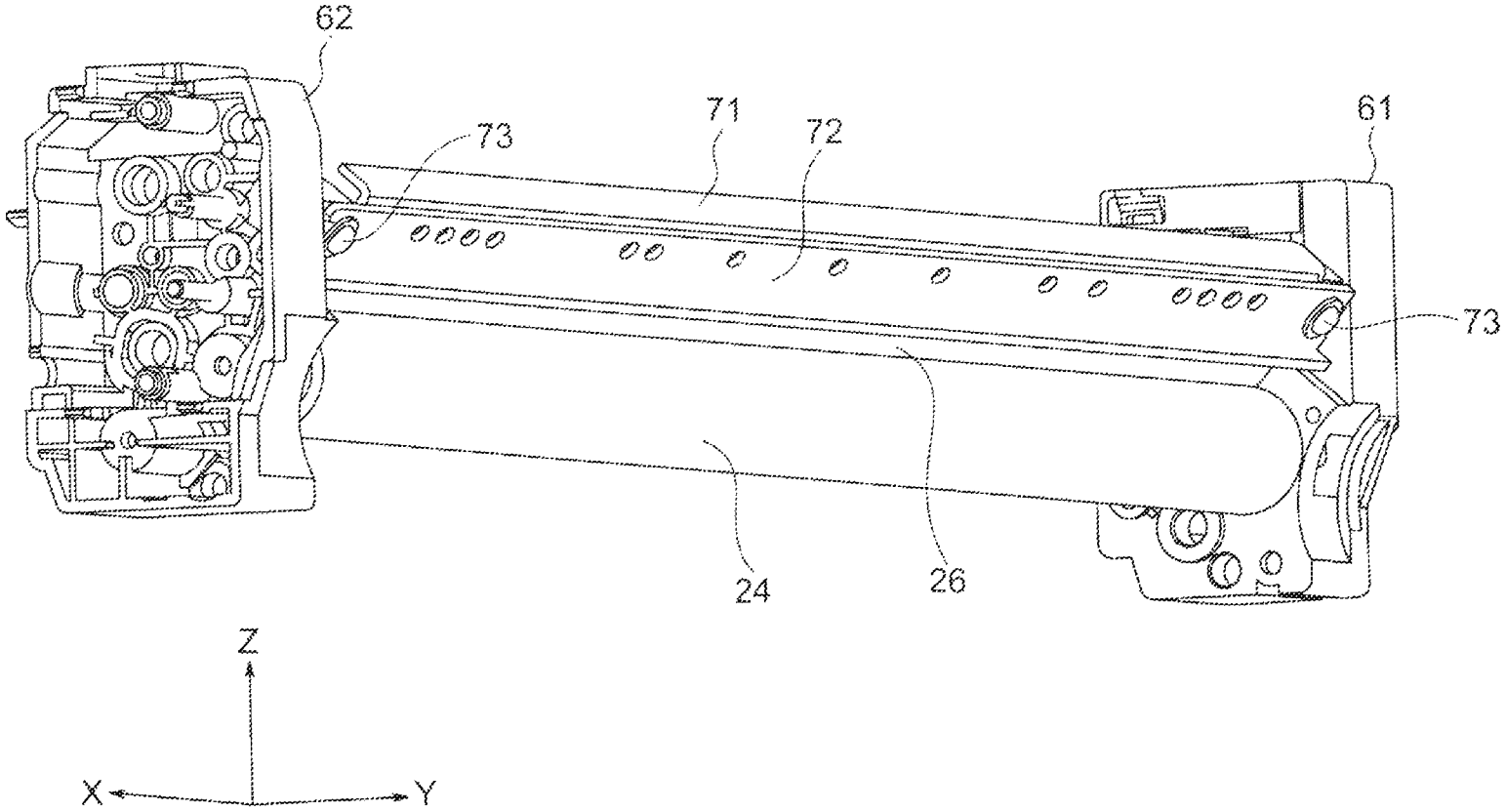
FIG. 6 is a perspective view illustrating the external shape of the development unit in the embodiment of the invention seen from a direction substantially opposite from that of FIG. 5.

FIG. 3 is a perspective view illustrating process unit 21 with developer cartridge 28 (FIG. 2) detached. FIG. 4 is an exploded perspective view illustrating drum unit 5 and development unit 6, which form process unit 21. FIG. 5 is a perspective view illustrating the external shape of development unit 6. FIG. 6 is a perspective view illustrating the external shape of development unit 6 seen from a direction substantially opposite to that of FIG. 5.

As illustrated in FIG. 3, development unit 6 is attached to drum unit 5. At the top of development unit 6, receive port 69 is formed through which to receive the developer fed from developer cartridge 28.

As illustrated in FIG. 4, drum unit 5 and development unit 6 both have elongated shapes long in the X direction. Drum unit 5 includes a pair of frames 51, 52 supporting development unit 6 at the opposite ends thereof in the X direction.

As illustrated in FIG. 5, development unit 6 includes main frame 60 surrounding development roller 24 and feed roller 25, and side frames 61, 62 provided at the opposite ends of this main frame 60 in its longitudinal direction.

The inner surface of the main frame 60 faces the outer peripheral surface of each of development roller 24 and feed roller (FIG. 2) with a predetermined gap therebetween. Also, developer storage chamber 27 (FIG. 2) is formed inside main frame 60.

Development roller 24 and feed roller 25 are rotatably supported on side frames 61, 62. A drive gear train (not illustrated) that rotates development roller 24 and feed roller 25 is disposed inside side frame 61.

Multiple bosses 63, 64 are formed to protrude from side frames 61, 62, respectively (only one boss 64 is illustrated). Bosses 63, 64 engage with engagement holes 53, 54 (FIG. 4) formed in frames 51, 52 of drum unit 5, respectively. Drum unit 5 and development unit 6 are united by the engagement of engagement holes 53, 54 and bosses 63, 64.

Shaft portion 65 that transmits a rotational drive force to the drive gear train projects from the outer side of side frame 61. This shaft portion 65 is inserted in circular hole 55 (FIG. 4) formed in frame 51 of drum unit 5. Drum gear 22*a* (FIG. 4) attached to the rotation shaft of photosensitive drum 22 is arranged at one end of drum unit 5 in its longitudinal direction (the end on the same side as side frame 61).

A rotational drive force from a drum motor provided to the body of image formation apparatus 1 is transmitted to drum gear 22*a* of photosensitive drum 22 and further to shaft portion 65 of development unit 6 as well. As a result, photosensitive drum 22, development roller 24, and feed roller 25 rotate at respective predetermined rotational speeds in the directions indicated by the respective arrows in FIG. 2.

Development blade 26, which is in contact with development roller 24 to make the developer into a thin layer, is attached to side frames 61, 62.

<Configuration and Attachment Structure of Development Blade>

Figure 7:
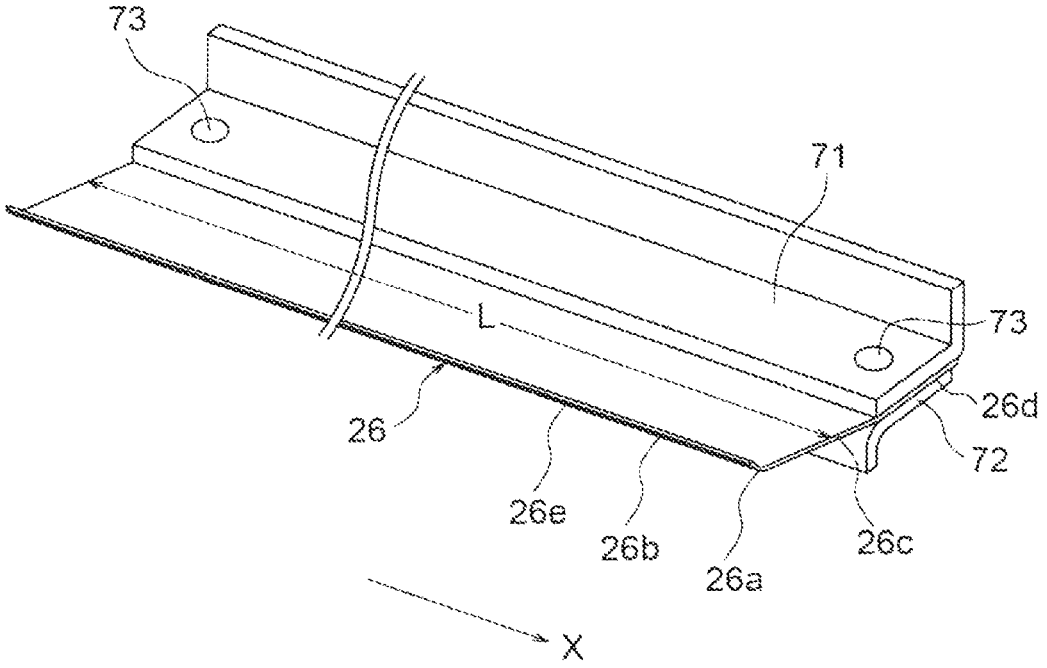
FIG. 7 is a perspective view illustrating a development blade and fixation plates therefor in the embodiment of the invention.
Figure 8:
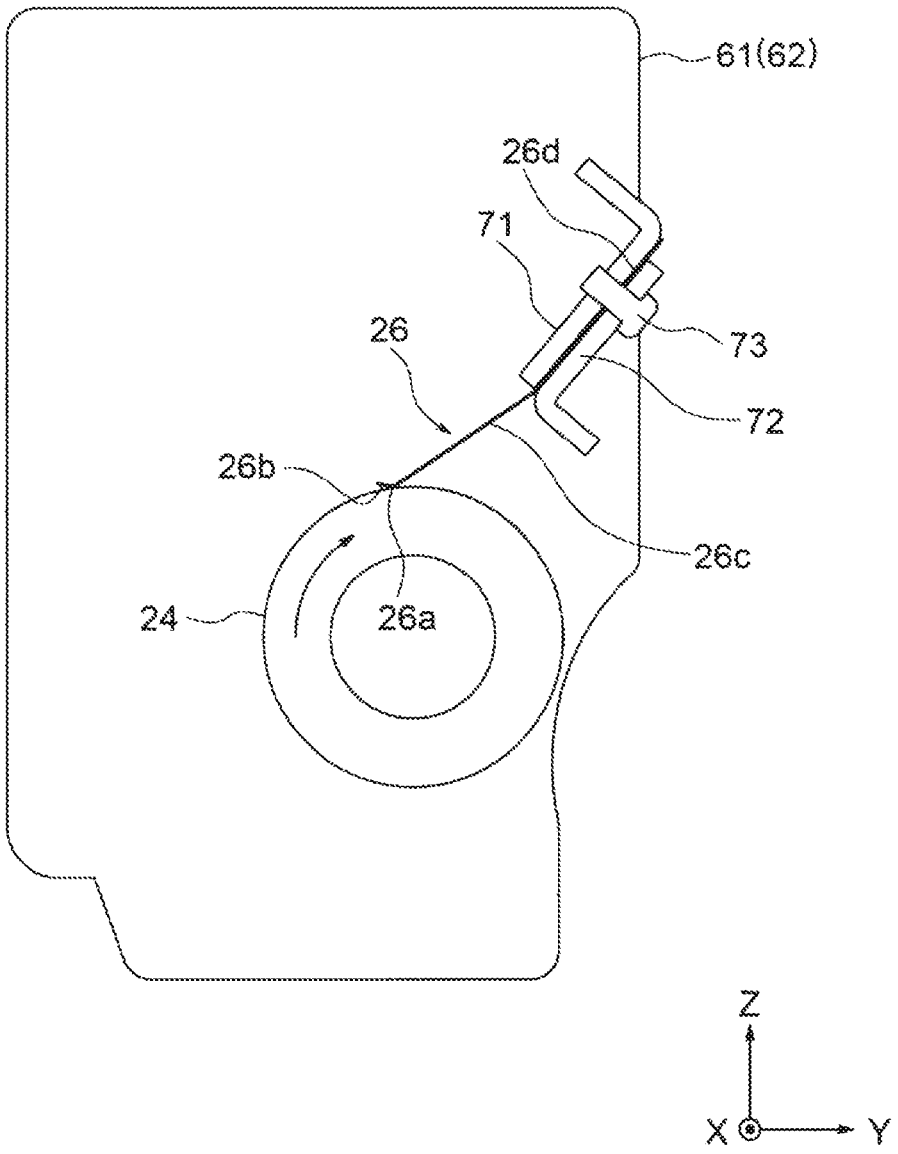
FIG. 8 is a schematic view illustrating the attachment structure of the development blade in the embodiment of the invention.
Figure 9:
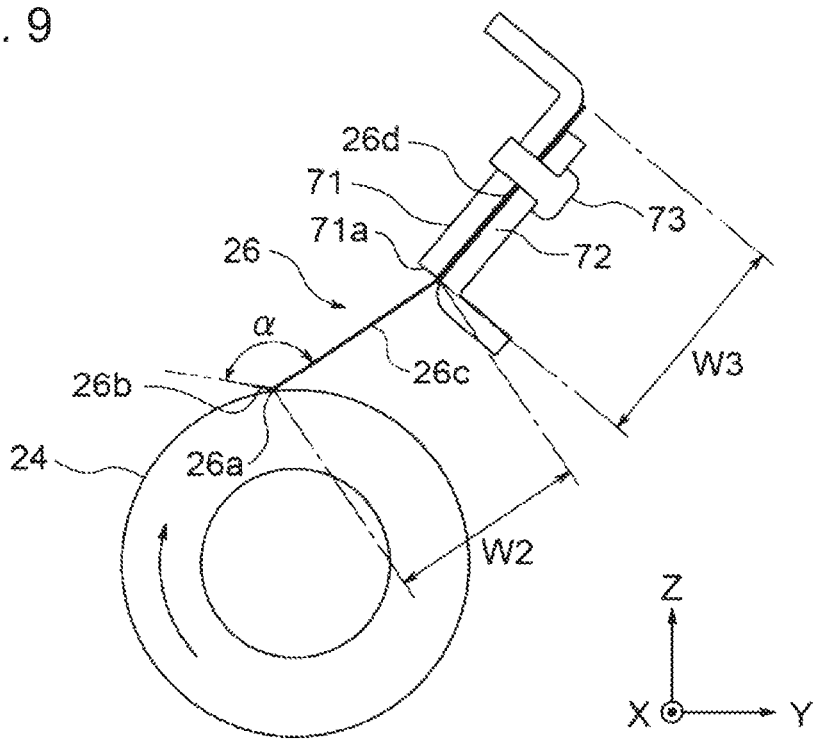
FIG. 9 is a schematic view illustrating the development blade, the fixation plates, and a development roller in the embodiment of the invention.
Figure 10:
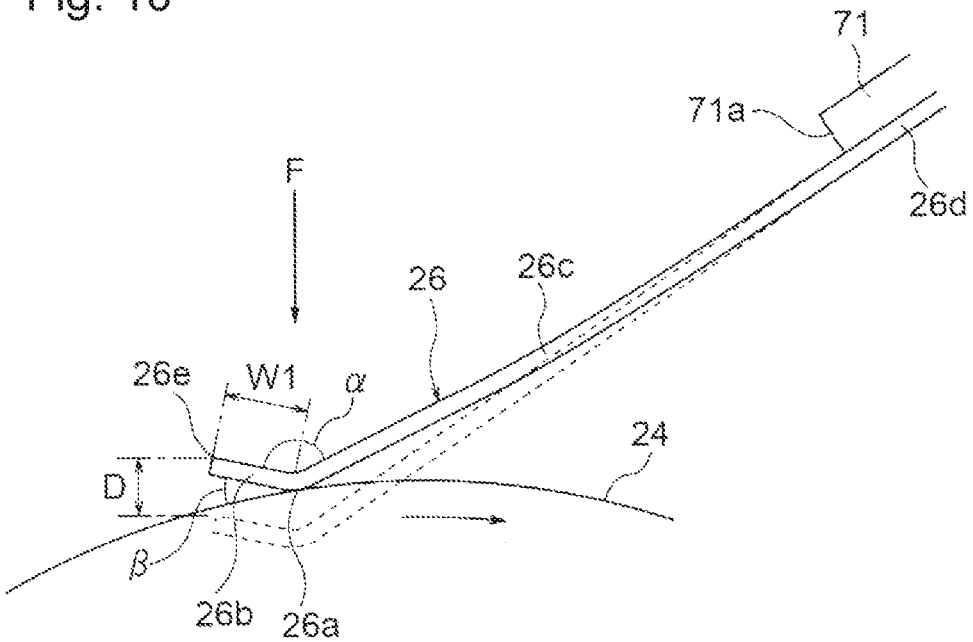
FIG. 10 is an enlarged schematic view illustrating contact portions of the development blade and the development roller in the embodiment of the invention.

Next, the configuration and attachment structure of development blade 26 are described with reference to FIG. 7 to FIG. 11. FIG. 7 is a perspective view illustrating development blade 26 and fixation plates 71, 72. FIG. 8 is a schematic view illustrating the attachment structure of development blade 26. FIG. 9 is a schematic view illustrating development roller 24, development blade 26, and fixation plates 71, 72. FIG. 10 is an enlarged schematic view illustrating the contact portions of development blade 26 and development roller 24.

As illustrated in FIG. 7, development blade 26 is an elongated member extending in the X direction. The length of development blade 26 in the X direction (longitudinal dimension) is L. Length L is 341.5 mm, for example. One end portion of development blade 26 in its widthwise direction is clamped and fixed by a pair of metallic fixation plates 71, 72.

The portion of development blade 26 fixed by fixation plates 71, 72 is referred to as fixed portion 26*d*. A portion of development blade 26 extending from fixed portion 26*d* toward development roller 24 is referred to as extending portion 26*c*. Extending portion 26*c* is bent at a predetermined position at an angle $\alpha$ (FIG. 9). This bent portion forms contact portion 26*a* which comes into contact with the surface of development roller 24, as illustrated in FIG. 8.

As illustrated in FIG. 7 and FIG. 8, fixation plates 71, 72 are both members long in the X direction, and are fixed at their opposite end portions in the X direction to side frames 61, 62. Fixation plates 71, 72 and development blade 26 are united by a pair of screws 73, for example, at the opposite sides of fixation plates 71, 72 in the X direction. Here, fixation plates 71, 72 have L-shaped cross sections in a plane perpendicular to the X direction, but are not limited to these shapes.

As illustrated in FIG. 9, the width of fixed portion 26*d* of development blade 26 (the portion fixed by fixation plates 71, 72) is W3 in a plane perpendicular to the X direction. Width W3 is 13.9 mm, for example.

Also, the width of development blade 26 from the end of fixed portion 26*d* (i.e. end 71*a* of fixation plate 71) to contact portion 26*a* is W2. Width W2 is 16.7 mm, for example.

When contact portion 26*a* of development blade 26 is pressed against the surface of development roller 24, extending portion 26*c* of development blade 26 is elastically deformed from the state illustrated by the broken line in FIG. 10 to the state illustrated by the solid line in FIG. 10. Contact portion 26*a* is pressed against the surface of development roller 24 by utilizing the reaction of this elastic deformation (flexure) of development blade 26. Contact pressure F (linear pressure) of development blade 26 on development roller 24 is 0.41 N/cm, for example.

A portion of development blade 26 from contact portion 26*a* to tip (free end) 26*e* forms tip flat portion 26*b* extending flatly. The width of tip flat portion 26*b* is W1 in a plane perpendicular to the X direction. Tip flat portion 26*b* and the surface of development roller 24 form predetermined angle β.

Note that development roller 24 rotates in the clockwise direction in FIG. 8 to FIG. 10. Tip 26*e* (free end) of development blade 26 is situated most upstream in the direction of the rotation of development roller 24. As development roller 24 rotates, the developer adhered to the surface of development roller 24 passes tip flat portion 26*b* of development blade 26 and reaches contact portion 26*a*, at which the thickness of the developer layer is regulated.

Development blade 26 is made of a metal such as stainless steel (SUS), for example, and its Young's module is 19000 $Kgf/mm^2$, for example. Thickness t and bend angle α of development blade 26 and width W1 of tip flat portion 26*b* are described later.

The surface of contact portion 26*a* of development blade 26 (the contact surface that comes into contact with development roller 24) has a predetermined curvature and has been subjected to a process, such as buffing or blasting, that reduces the surface roughness.

The thickness of the developer layer on the surface of development roller 24 is controlled mainly by development voltage Vb to be applied to development roller 24, blade voltage V1 to be applied to development blade 26, and contact pressure F of development blade 26 on development roller 24.

<Operation of Image Formation Apparatus>

Next, the print operation (image formation) of image formation apparatus 1 is described with reference to FIG. 1 and FIG. 2. A controller of image formation apparatus 1 starts the print operation upon receipt of a print command and print data from a higher-level apparatus such as a personal computer.

First, pick-up roller 14 and feed roller 15 rotate to individually feed paper sheets P stored in paper feed cassette 10 onto the conveyance path.

After the leading end of paper sheet P fed onto the conveyance path reaches the nip portion of first registration roller pair 18, first registration roller pair 18 starts to rotate at the predetermined timing, thereby conveying paper sheet P with its skew corrected. Further, second registration roller pair 19 rotates to convey paper sheet P toward image formation section 20.

Furthermore, belt drive roller 34*a* of transfer belt unit 31 starts to rotate, thereby running transfer belt 33. Transfer belt 33 attracts and holds paper sheet P conveyed from second registration roller pair 19 and conveys paper sheet P to process units 21K, 21Y, 21M, 21C in this order.

At each process unit 21, charge voltage Vc, development voltage Vb, feed voltage Vs, and blade voltage V1 are applied to photosensitive drum 22, charge rollers 23, development roller 24, feed roller 25, and development blade 26 from charge-roller power supply 81, development-roller power supply 82, feed-roller power supply 83, and blade power supply 84.

Moreover, at each process unit 21, photosensitive drum 22 rotates, and charge rollers 23, development roller 24, and feed roller 25 also rotate accordingly. Charge rollers 23, with the charge voltage applied thereto, uniformly charge the surface of photosensitive drum 22. Then, LED head 30 irradiates the surface of photosensitive drum 22 with light to form an electrostatic latent image thereon.

The developer stored in developer storage 27 of each process unit 21 is fed onto development roller 24 by feed roller 25 and adheres to the surface of development roller 24. The developer adhering to the surface of development roller 24 becomes a developer layer of a certain thickness by passing between development roller 24 and development blade 26.

The developer layer formed on the surface of development roller 24 then adheres to the electrostatic latent image on the surface of photosensitive drum 22, thereby developing the electrostatic latent image. Further, transfer voltage Vt is applied to transfer roller 32 from transfer-roller power supply 85, and the developer image formed on the surface of photosensitive drum 22 is transferred onto paper sheet P on transfer belt 33. Note that the developer not transferred onto paper sheet P is scraped off by cleaning member 29.

The developer images of the four color thus formed by process units 21K, 21Y, 21M, 21C are sequentially transferred onto paper sheet P and superimposed one over another. Paper sheet P with the developer images of the four colors transferred thereon is conveyed further by transfer belt 33 and then reaches fixation device 35.

At fixation device 35, fixation roller 36 and press roller 37 apply heat and pressure to paper sheet P, so that the developers are fixed to paper sheet P. Paper sheet P with the developer images fixed thereto is discharged by first discharge roller pair 39 and second discharge roller pair 40 and placed on stacker unit 41. By this step, the formation of a color image onto paper sheet P is completed.

<Configuration for Suppressing Print Defects>

Next, a description is given of a configuration in the embodiment of the invention for suppressing print defects resulting from the waviness of contact portion 26*a* of development blade 26.

FIG. 11 is a schematic view for explaining how development blade 26 having a waviness on contact portion 26*a* comes into contact with development roller 24. When development blade 26 is subjected to bending, a waviness is sometimes generated on the surface of contact portion 26*a* of development blade 26 (the surface that comes into contact with development roller 24). The waviness generated on the surface of contact portion 26*a* causes an uneven contact between development blade 26 and development roller 24 in the longitudinal direction of development blade 26 (the X direction).

Specifically, at those portions of development blade 26 and development roller 24 with wider gaps therebetween, the contact pressure is lower, thereby making the developer layer thicker and making the image denser in color. On the other hand, at those portions of development blade 26 and development roller 24 with narrower gaps therebetween, the contact pressure is higher, thereby making the developer layer thinner and making the image lighter in color. As a consequence, print defects occur on the print image such as density unevenness and vertical strips (a strip-shaped unevenness extending along the circumferential direction of development roller 24).

During the bending of development blade 26, it is possible to adjust work conditions and the like so as not to generate a waviness of hundreds of μm, yet it is difficult to prevent a waviness of tens of μm. Since the particle size of the developer is 10 μm or smaller, even a waviness of tens of μm can possibly influence the thickness of the developer layer.

For this reason, in this embodiment, development blade 26 is made to be easily deformable such that contact portion 26*a* of development blade 26 can come into contact with development roller 24 along the surface shape of development roller 24 and the developer layer on development roller 24 can be even in thickness.

Specifically, the ratio of amount D of displacement (FIG. 10) of contact portion 26*a* to length L (FIG. 7) of development blade 26 is set to be large in the state where development blade 26 is attached to fixation plates 71, 72, i.e. in the state where development blade 26 is pressed against development roller 24 at a predetermined contact pressure (0.41 N/cm here). This is because the larger the ratio of amount D of displacement to length L of development blade 26 (D/L), the more easily that contact portion 26*a* of development blade 26 is deformed along the surface shape of development roller 24 (in other words, the lower the rigidity).

For example, in a case where bend angle α of development blade 26 is 135°, width W1 of tip flat portion 26*b* is 0.5 mm, and thickness t of development blade 26 is 0.08 mm, then the value of D/L is 0.295% under a condition where length L of development blade 26 is 341.5 mm and the contact load is 14.01 N (a linear pressure of 0.41 N/cm). In this case, when development blade 26 and development roller 24 come into contact with each other, the surface of development blade 26 is deformed along development roller 24, thereby suppressing the waviness of the surface of contact portion 26*a* of development blade 26.

<Print Test>

Here, a print test is conducted with the value of D/L varied to five different values of 0.148%, 0.274%, 0.283%, 0.295%, and 0.376%.

In the print test, a color printer which is image formation apparatus 1, illustrated in FIG. 1, is used. Of process units 21K, 21Y, 21M, 21C, only process unit 21C (cyan) is actuated to print a predetermined print pattern on plain paper sheets (70 kg/1000 sheets) of an A3+ size (329 mm×483 mm).

Also, the development blade 26 used is made of stainless steel (SUS) having a Young's modulus of 19000 Kgf/cm$^2$ as mentioned above. The contact load of development blade 26 on development roller 24 is 14.01 N (a linear pressure of 0.41 N/cm). The development roller 24 used has an elastic layer made of semiconductive urethane rubber with an Asker C hardness of 80±5°.

Charge voltage Vc to be applied to charge rollers 23 is −970 V, development voltage Vb to be applied to development roller 24 is −160 V, and feed voltage Vs to be applied to feed roller 25 is −260 V. Blade voltage V1 to be applied to development blade 26 is −290 V, and transfer voltage Vt to be applied to transfer roller 32 is 2000 V. The print pattern is a cyan solid image.

The print pattern thus printed is visually observed to determine the presence or absence of print defects (density unevenness, vertical strips) resulting from the waviness of contact portion 26*a* of development blade 26. FIG. 12 illustrates the result of the determination.

In FIG. 12, print defects are found in the case where the value of D/L is 0.148%, and minor print defects are found in the case where the value of D/L is 0.274%. On the other hand, no print defects are found and fine print images are obtained in the case where the value of D/L is 0.283%, 0.295%, or 0.376%.

This indicates that setting the value of D/L at or above 0.283% makes it possible to suppress the occurrence of print defects resulting from the waviness of contact portion 26*a* of development blade 26.

The value of D/L can be controlled mainly by bend angle α of development blade 26, width W1 of tip flat portion 26*b*, and thickness t of development blade 26. In the following, a description is given of the desirable ranges of bend angle α of development blade 26, width W1 of tip flat portion 26*b*, and thickness t of development blade 26.

FIG. 13 is a graph illustrating the change in value of D/L versus bend angle α (°) of development blade 26. Here, the value of D/L with bend angle α of development blade 26 set at 90° is considered to be 1 (reference value), and the values of D/L with bend angle α varied to 70°, 115°, and 140° are presented as ratios to the reference value.

FIG. 13 indicates that the larger the bend angle α of development blade 26, the larger the value of D/L (i.e. the more easily development blade 26 is deformed). For this reason, bend angle α of development blade 26 is desirably an obtuse angle (>90) and is as large as possible at the same time.

However, if bend angle α of development blade 26 is greater than 140°, angle β (FIG. 10) between tip flat portion 26*b* of development blade 26 and the surface of development roller 24 is too small. This results in the possibility that the developer layer might be thin, thereby causing an insufficient feed of the developer, or that the developer might firmly adhere to the surface of development blade 26 or development roller 24. In order to set a large value of D/L without causing the insufficient feed or firm adhesion of the developer, bend angle α of development blade 26 is desirably within the range of 115° to 140°.

Figure 14:
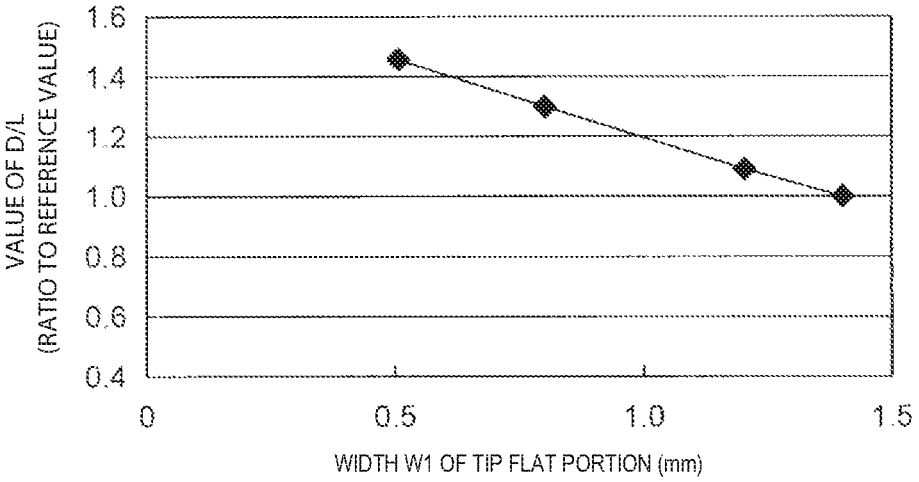
FIG. 14 is a graph illustrating changes in the value of D/L versus the width of a tip flat portion of the development blade.

FIG. 14 is a graph illustrating a change in value of D/L versus width W1 (mm) of tip flat portion 26*b* of development blade 26. Here, the value of D/L with width W1 of tip flat portion 26*b* of development blade 26 being set at 1.4 mm is considered to be 1 (reference value), and the values of D/L with width W1 varied to 0.5 mm, 0.8 mm, and 1.2 mm are presented as ratios to the reference value.

FIG. 14 indicates that the smaller the width W1 of tip flat portion 26*b* of development blade 26, the larger the value of D/L. In particular, setting width W1 of tip flat portion 26*b* of development blade 26 at or below 0.6 mm is significantly effective in increasing the value of D/L (making development blade 26 more easily deformable). For this reason, width W1 of tip flat portion 26*b* of development blade 26 is desirably less than or equal to 0.6 mm.

However, if width W1 of tip flat portion 26*b* of development blade 26 is too small, a problem arises in that it is difficult to manufacture development blade 26 and the manufacturing cost increases. In order to set a large value of D/L and suppress the increase in manufacturing cost, width W1 of tip flat portion 26*b* of development blade 26 is desirably within the range of 0.4 mm to 0.6 mm.

Figure 15:
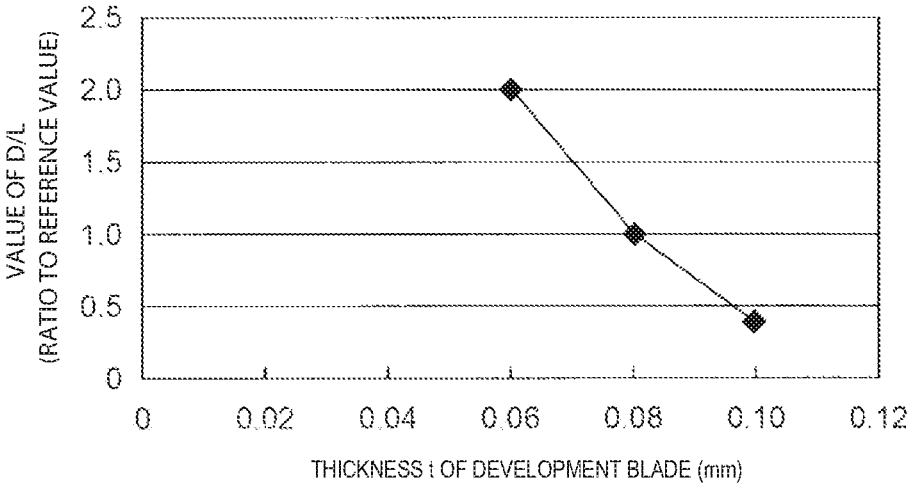
FIG. 15 is a graph illustrating changes in the value of D/L versus the thickness of the development blade.

FIG. 15 is a graph illustrating a change in the value of D/L versus thickness t (mm) of development blade 26. Here, the value of D/L with thickness t of development blade 26 being set at 0.08 mm is considered to be 1 (reference value), and the values of D/L with thickness t varied to 0.06 mm and 0.1 mm are presented as ratios to the reference value.

FIG. 15 indicates that the smaller the thickness t of development blade 26, the larger the value of D/L. In particular, setting thickness t of development blade 26 at or below 0.08 mm is significantly effective in increasing the value of D/L (making development blade 26 more easily deformable). For this reason, thickness t of development blade 26 is desirably less than or equal to 0.08 mm.

However, if the thickness t of development blade 26 is too small, it is difficult for development blade 26 to withstand the contact pressure F, which is applied thereto. In order to set a large value of D/L and ensure sufficient pressure resistance, thickness t of development blade 26 is desirably within the range of 0.04 mm to 0.08 mm.

These results indicate that setting the value of D/L at or above 0.283% makes it possible to suppress print defects resulting from the waviness of the surface of contact portion 26*a* of development blade 26. Also, the results indicate that, in order to suppress the print defects more effectively, it is desirable to set bend angle α of development blade 26 at 115° to 140°, set width W1 of tip flat portion 26*b* at or below 0.6 mm, and thickness t of development blade 26 at or below 0.08 mm.

<Advantageous Effects of Embodiment>

As described above, according to the embodiment of the invention, setting the value of D/L, which is the ratio of the amount D of displacement of contact portion 26*a* to the length L of development blade 26, at or above 0.283% makes it possible to make development blade 26 more easily deformable (reduce the rigidity) and thus suppress the waviness of the surface of contact portion 26*a* of development blade 26. As a result, the thickness of the developer layer to be formed on the surface of development roller 24 can be even and print defects such as density unevenness and vertical strips can be suppressed.

In particular, the print defects can be suppressed and fine images can be formed by setting bend angle α of development blade 26 at 115° to 140°, setting width W1 of tip flat portion 26*b* at or below 0.6 mm, and setting thickness t of development blade 26 at or below 0.08 mm.

Note that the above description has been given of a color printer as an example of the image formation apparatus, but the image formation apparatus is not limited to a color printer and may be a monochrome printer. Also, the image formation apparatus is not limited to a printer and may be a photocopier, a facsimile, a MFP, or the like.

Also, the above description has been given of the image formation apparatus of the direct transfer type, which directly transfers the developer images formed at the process units onto a paper sheet (medium) on the transfer belt. However, the image formation apparatus may be of an indirect transfer type, which transfers the developer images onto a medium by using an intermediate transfer unit (such as an intermediate transfer belt), for example.

Also, the numerical values of the development blade such as, for example, 341.5 mm as its length, 14.01 N as its contact load, and 19000 Kgf/cm as its Young's modulus are mere examples, and can be optionally changed in accordance with the mode of use of the development blade.

The invention is applicable to image formation apparatuses such as, for example, photocopiers, printers, facsimiles, and MFPs and to their image formation units.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation unit comprising:

an image carrier that carries an electrostatic latent image;

a developer carrier that carries a developer and develops the electrostatic latent image on the image carrier; and a developer regulation member that includes a contact portion which comes into contact with a surface of the developer carrier and that regulates a thickness of a developer layer to be formed on the surface of the developer carrier, wherein a value of D/L is greater than or equal to 0.283%, where D is an amount of displacement of the contact portion of the developer regulation member caused by contact of the contact portion with the surface of the developer carrier under a linear pressure of 0.41 N/cm, where the amount of displacement D is a distance along the direction of the linear pressure between a first position of the contact portion in a state where the contact portion is not in contact with the surface of the developer carrier and a second position of the contact portion in a state where the contact portion is in contact with the surface of the developer carrier under the linear pressure of 0.41 N/cm, and L is a dimension of the developer regulation member in a longitudinal direction thereof.

2. The image formation unit according to claim 1, wherein the value of D/L is less than or equal to 0.376%.

3. The image formation unit according to claim 1, wherein the developer regulation member comprises a shape bent at the contact portion at a predetermined inner angle, and the predetermined inner angle is within a range of 115° to 140°.

4. The image formation unit according to claim 1, wherein a thickness of the developer regulation member is less than or equal to 0.08 mm.

5. The image formation unit according to claim 1, wherein the developer regulation member is fixed, on one side thereof relative to the contact portion, to a body of the image formation unit, and includes, on an opposite side thereof relative to the contact portion, a free end, and a distance from the contact portion to the free end is less than or equal to 0.6 mm.

6. The image formation unit according to claim 5, wherein the developer carrier rotates in one direction, and the free end of the developer regulation member is situated upstream of the contact portion in the direction of the rotation of the developer carrier.

7. The image formation unit according to claim 5, wherein the developer regulation member includes an elastically deformable extending portion between a fixed portion fixed to the body of the image formation unit and the contact portion.

8. The image formation unit according to claim 7, further comprising a pair of fixation plates that clamp the fixed portion of the developer regulation member.

9. The image formation unit according to claim 1, wherein the developer regulation member is made of stainless steel.

10. An image formation apparatus comprising:

the image formation unit according to claim 1;

a medium feeder that feeds a medium to the image formation unit;

a transfer unit that transfers a developer image from the image carrier onto the medium; and a fixation unit that fuses the developer image to the medium.

11. An image formation apparatus according to claim 10, further comprising:

a power supply that supplies voltages the developer carrier and the developer regulation member respectively.

12. The image formation unit according to claim 5, wherein the distance from the contact portion to the free end is not less than 0.4 and is not greater than 0.6.

13. The image formation unit according to claim 4, wherein the thickness of the developer regulation member is not less than 0.04 and is not greater than 0.08 mm.

* * * * *